US006401937B1

(12) United States Patent
Schmidt

(10) Patent No.: US 6,401,937 B1
(45) Date of Patent: Jun. 11, 2002

(54) APPARATUS AND METHOD TO SEPARATE CORRUGATED PAPER FROM COMMINGLED WASTE

(76) Inventor: Karl W. Schmidt, 3900 E. 68th Ave., Commerce City, CO (US) 80022-2247

( * ) Notice: Subject to any disclaimer, the term of this patent is extended or adjusted under 35 U.S.C. 154(b) by 0 days.

(21) Appl. No.: 09/543,726

(22) Filed: Apr. 5, 2000

(51) Int. Cl.[7] ..... B07B 13/07; B07B 13/075

(52) U.S. Cl. ..... 209/674; 209/660; 209/659; 209/916; 209/921; 209/677

(58) Field of Search ..... 209/674, 660, 209/659, 916, 921, 677

(56) References Cited

U.S. PATENT DOCUMENTS

| | | | | |
|---|---|---|---|---|
| 1,441,042 | A | | 1/1923 | Thackray |
| 1,466,029 | A | | 8/1923 | Peters |
| 1,552,397 | A | | 9/1925 | Edwards |
| 1,606,301 | A | * | 11/1926 | Jones |
| 2,722,406 | A | | 11/1955 | Kurek |
| 3,324,992 | A | | 6/1967 | Morgan |
| 3,462,004 | A | | 8/1969 | Hill |
| 3,471,134 | A | | 10/1969 | Cone |
| 3,753,489 | A | | 8/1973 | Tomioka et al. |
| 3,971,716 | A | * | 7/1976 | Foreman |
| 4,211,321 | A | | 7/1980 | Mosher |
| 4,285,434 | A | | 8/1981 | Schuricht |
| 4,504,386 | A | | 3/1985 | Dyren et al. |
| 4,624,614 | A | | 11/1986 | Levad et al. |
| 4,653,344 | A | | 3/1987 | Nelson |
| 4,660,726 | A | | 4/1987 | Woode |
| 4,928,811 | A | | 5/1990 | Waineo |
| 5,086,912 | A | | 2/1992 | Howden, Jr. |
| 5,117,983 | A | | 6/1992 | Marrs |
| 5,242,046 | A | | 9/1993 | Bailey |
| 5,314,330 | A | | 5/1994 | Orbeck |
| 5,437,360 | A | | 8/1995 | Eberhard |
| 5,613,595 | A | | 3/1997 | Ukada |
| 5,653,570 | A | | 8/1997 | Weirathmueller |
| 5,868,259 | A | * | 2/1999 | Bielagus ..... 209/674 |
| 6,003,682 | A | | 12/1999 | Bielagus |
| 6,006,922 | A | | 12/1999 | Bielagus |

* cited by examiner

*Primary Examiner*—Donald P. Walsh
*Assistant Examiner*—Jonathan R. Miller
(74) *Attorney, Agent, or Firm*—Dorr, Carson, Sloan & Birney, P.C.

(57) ABSTRACT

An apparatus and method for separating recyclable corrugated paper from a stream of commingled waste. Commingled waste is loaded onto a conveyor with two alternating sets of jogger beams. A motor drives the jogger beams out of phase with respect to one another causing the waste to fall between the jogger beams, while corrugated paper remains above and moves along the jogger beams, thereby separating the two components. Optionally, a second stage of jogger beams can be positioned forward of the conveyor to create a drop therebetween to further separate the commingled waste. The jogger beams are cantilevered beyond the motor so that waste falls clear of the motor.

18 Claims, 6 Drawing Sheets

APPARATUS AND METHOD TO SEPARATE CORRUGATED PAPER FROM COMMINGLED WASTE

BACKGROUND OF THE INVENTION

1. Field of the Invention

The present invention relates generally to the field of separating recyclables from commingled waste. More specifically, the present invention discloses a jogger beam apparatus that separates corrugated paper from a stream of commingled waste.

2. Statement of the Problem

Corrugated paper has resale value on the recycling market. For the purposes of this application, "corrugated paper" should be construed to include both corrugated paper and cardboard. However, the corrugated paper must first be separated from the commingled waste which can include paper, cans, and other household waste. This can be done manually, but at a significant cost. Alternatively, mechanical conveyors have been developed that separate corrugated paper from commingled waste. One such conveyor includes a series of rotating spindles with teeth or fingers. The commingled waste is loaded onto the rotating spindles at one end of the conveyor. As the commingled waste moves across the rotating spindles, the waste component drops between the rotating spindles while the corrugated paper is transferred across the upper surface of the rotating spindles to a second end where it is collected. However, the commingled waste often contains wire, shredded strips of plastic, and other string-like components that tend to wrap around the rotating spindles. Eventually the rotating spindles must be shut down and the string-like components manually removed from the spindles, thus decreasing its efficiency. That is, the apparatus must be shut down during cleaning, reducing output, and manpower is required to clean the conveyor, increasing operational costs. In addition, having people clean the spindles poses a safety risk.

Conveyors, including walking-beam conveyors, have been used in the past in a wide variety of other fields, including the following:

| Inventor | Patent No. | Issue Date |
|---|---|---|
| Thackray | 1,441,042 | Jan. 2, 1923 |
| Peters | 1,466,029 | Aug. 28, 1923 |
| Kurek | 2,722,406 | Nov. 1, 1955 |
| Morgan | 3,324,992 | Jun. 13, 1967 |
| Hill | 3,462,004 | Aug. 19, 1969 |
| Cone | 3,471,134 | Oct. 7, 1969 |
| Tomioka et al. | 3,753,489 | Aug. 21, 1973 |
| Mosher | 4,211,321 | Jul. 8, 1980 |
| Schuricht | 4,285,434 | Aug. 25, 1981 |
| Levad, et al. | 4,624,614 | Nov. 25, 1986 |
| Nelson | 4,653,344 | Mar. 31, 1987 |
| Waineo | 4,928,811 | May 29, 1990 |
| Howden | 5,086,912 | Feb. 11, 1992 |
| Bailey | 5,242,046 | Sep. 7, 1993 |
| Orbeck | 5,314,330 | May 24, 1994 |
| Eberhard | 5,437,360 | Aug. 1, 1995 |
| Ukada | 5,613,595 | Mar. 25, 1997 |
| Weirathmueller | 5,653,570 | Aug. 5, 1997 |

Thackray discloses a cooling bed apparatus for transferring metal bars both longitudinally and laterally step by step.

Peters discloses a feeding mechanism. Two or more reciprocating longitudinal members are formed to provide a series of spaced engaging surfaces and a series of rearwardly sloping inclines alternating with the engaging surfaces. The reciprocation causes an article placed on the members to move forward along the members.

Kurek discloses a magnetic conveyor and agitator having a track comprised of two parallel pairs of steel rails. The articles on the conveyor are moved along the rail assemblies by relative movement of one set of rails with respect to the other so that each item on the conveyor is periodically lifted from the surface of the stationary rails by a pair of movable rails, moved a short step forward and replaced on the stationary rails.

Morgan discloses an apparatus for transferring elongated elements laterally from one location to another.

Hill discloses an improvement to a movable transfer rack. Each section of the transfer rack is actuated by only two combination eccentrics and crank pins at the cool side of the bed. The hot side is supported by struts mounted on bell cranks connected to and moved by tension members affixed to crankpins on the eccentrics. Hence, the overhang of the transfer racks minimizes overloading of the cantilevered ends.

Cone discloses a walking beam conveyor with a fixed set of parallel horizontally disposed rails and a reciprocable carriage with a set of similarly disposed rails for intermittently and alternatively holding and conveying material through a furnace.

Tomioka et al. disclose a series of aligned presses, each with independent operational sections, for automatically transferring formed articles between presses. Formed articles are loaded and unloaded between the presses by a cyclic motion consisting of lifting, advancing, lowering and retreating of the transferring mechanism.

Mosher discloses a general purpose walking beam conveyor.

Schuricht discloses a walking beam conveyor with an adjustable width gauging aperture.

Levad et al. disclose an apparatus for pack cooling flat stock including collecting means with a plurality of stacker arms mounted for movement with respect to the stationary notch bars between a retracted position and a lifting position.

Nelson discloses a bearing system.

Waineo discloses a walking beam apparatus with four cams mounted on the base support so that as the lifting frame is moved back and forth, it rises or falls on the base depending on the frame's direction of motion.

Howden, Jr. discloses an ambulatory for conveying rolls of carpet from a first elevation to a second elevation in a step-wise manner.

Bailey discloses a mechanical conveyor with an exposed flexible membrane surface that transfers articles by small orbital motions.

Orbeck discloses a walking hearth furnace in which a work product is conveyed through a furnace by rectilinear beam motion. At no point in the cycle does the work product, rods, or beams make contact with the muffle, nor do the interleaved rods touch each other.

Eberhard discloses a system for conveying stacks of objects.

Ukada discloses an automatic slope fruit feeding machine with a fixed carrier and a movable carrier.

Weirathmueller discloses a stair-like log feeder having a movable drive module and a movable driven unit cooperating with one another to move logs upward in a successive series of displacements.

3. Solution to the Problem

None of the prior art references uncovered in the search show an apparatus used to separate corrugated paper from commingled waste in which the commingled waste is loaded onto one end of a conveyor having at least two jogger beams driven out of phase with respect to one another and cantilevered beyond the motor so that waste falls clear of the motor between the jogger beams and the corrugated paper remains above and moves along the jogger beams, thereby separating the two components.

SUMMARY OF THE INVENTION

A primary object of the present invention is to provide an apparatus and method for separating recyclable corrugated paper from commingled waste. The commingled waste is loaded onto a conveyor having two alternating sets of jogger beams. The jogger beams are cantilevered, so that waste or debris falls clear of the motor and are preferably inclined so that the waste remains over the jogger beams and is not carried into the collection hopper. The jogger beams also preferably include teeth formed on a single sheet of metal material that has been fashioned into a substantially U-shape and mounted to the upper surface of the jogger beams. Each set of jogger beams is operated by a drive mechanism having a support beam with first and second bell cranks pivotally attached thereto and linked to one another and to the crankshaft through a series of tie rods. A slide shoe that is pivotally attached to the second bell crank on each set of jogger beams, slidingly engages the respective set of jogger beams. Optionally, a skirt covers the drive mechanism to keep waste from becoming entangled in the moving components of the drive mechanism. The motor drives the jogger beams out of phase with respect to one another causing the crankshaft to rotate the linked or connected bell cranks, which in turn move the slide shoe. This movement causes one of the slide shoes to lift and thrust the engaged set of jogger beams forward while the other slide shoe lowers and retreats the other engaged set of jogger beams. This motion moves the commingled waste over the jogger beams so that the waste or debris falls between the jogger beams and the corrugated paper remains or "floats" above the jogger beams, thereby separating the two components. Optionally, a second stage of jogger beams can be positioned in series after the first stage of jogger beams to further separate the commingled waste. In such an embodiment, the periodic forward motion of the first stage of jogger beams causes the corrugated paper dropping from the conveyor onto the second stage of jogger beams to tumble and further separate the waste from the corrugated paper.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

1. Overview

Figure 1:
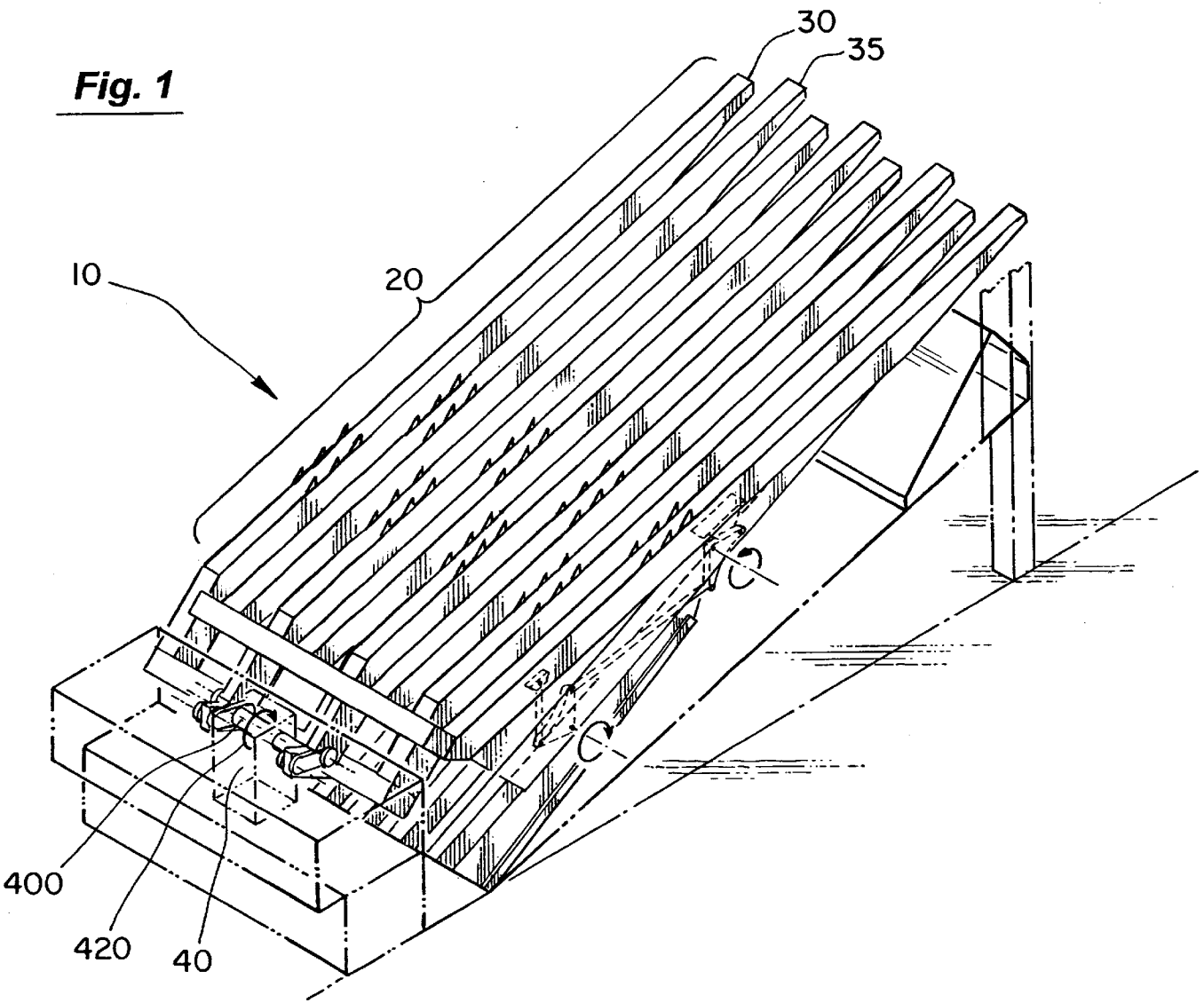
FIG. 1 is a perspective of a separating apparatus of the present invention.
Figure 2:
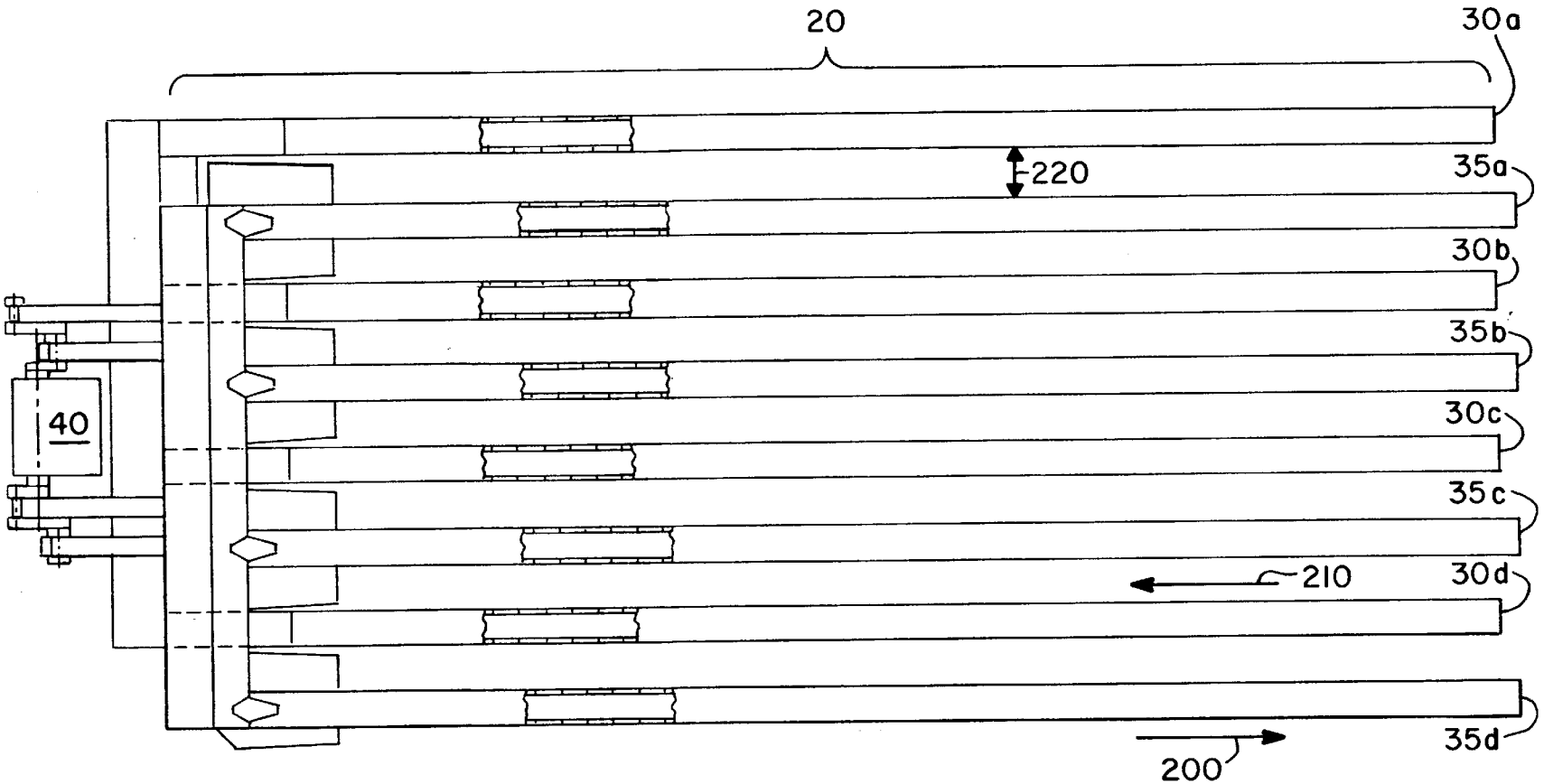
FIG. 2 is a top view of the separating apparatus.

A perspective view of an embodiment of the separating apparatus 10 of the present invention is shown in FIG. 1. The separating apparatus 10 includes a conveyor 20 having jogger beams 30, 35 that are driven out of phase with respect to one another by a crankshaft 400 powered by a motor 40. Preferably, as shown in FIG. 2, a first set of jogger beams 30*a–d* is lifted and thrust forward in unison (e.g., in the direction of arrow 200) while a second set of jogger beams 35*a–d* is lowered and returned in unison (e.g., in the direction of arrow 210), and vice versa to move a waste stream 300 (FIG. 3) along the conveyor 20. The jogger beams 30, 35 are spaced substantially parallel to one another and at a predetermined distance (i.e., 220 in FIG. 2) from one another that allows the waste component or debris 310 (FIG. 3) to fall between the jogger beams 30, 35 while retaining larger material (i.e., the corrugated paper 320) above the jogger beams 30, 35. As such, the corrugated paper 320 is separated from the waste stream 300 as the debris 310 falls between the jogger beams 30, 35 into a waste collection area 340*a*. The corrugated paper 320 continues to move across the conveyor 20 until it falls from the far or distal end into a collection hopper 330. The conveyor 20 is preferably cantilevered beyond the motor 40 as shown in FIGS. 1 and 2 so that the debris 310 falls clear of and does not become entangled with the motor 40 and the crankshaft 400. Also in a preferred embodiment, the separating apparatus 10 includes a loading hopper (e.g., 350*a*). The hopper is used to funnel the waste stream 300 onto the conveyor 20.

It is to be expressly understood that the conveyor 20 can have more than two sets of jogger beams 30*a–d* and 35*a–d*. Furthermore, the present invention is not limited to the number of jogger beams 30, 35 in each set, and each set can include one or more jogger beams 30, 35. In addition, each set of jogger beams 30*a–d* and 35*a–d* need not move. In another embodiment, for example, the first set of jogger beams 30*a–d* can move while the second set of jogger beams 35*a–d* is held stationary. Likewise, the collection hopper 330 and the waste collection area (e.g., 340*a*) can be a hopper, a truck or other container, or even a concrete slab.

Optionally, a second conveyor 20*b* (i.e., a second stage of jogger beams) can be positioned in series following the first conveyor 20*a*. In the embodiment shown in FIG. 3, two separating apparatuses 10*a* and 10*b* are positioned together to operate in conjunction with one another. However, in another embodiment, the second conveyor 20*b* can be part of the same separating apparatus 10 (not shown) and, for example, operated with a single motor 40. Use of the second conveyor 20*b* allows for further separation of the corrugated paper 320 from the waste stream 300. That is, as the corrugated paper 320 falls off of the far end of the first conveyor 20*a*, it is loaded onto the second conveyor 20*b*. The corrugated paper 320 and any remaining debris 315 that has not fallen into waste collection area 340*a* (i.e., debris that was stuck to, caught on or otherwise rode on top of the corrugated paper 320) is transferred to the second conveyor 20*b* where the remaining debris 315 falls between the jogger beams 30, 35 of the second conveyor 20*b* as described above with respect to the first conveyor 20*a* and into the waste collection area 340*b*. The corrugated paper 320 remains above and moves along the jogger beams 30, 35 and is collected (e.g., in hopper 330) at the far or distal end of the second conveyor 20*b*. More than two stages of conveyors can be employed in series, if desired.

Figure 3:
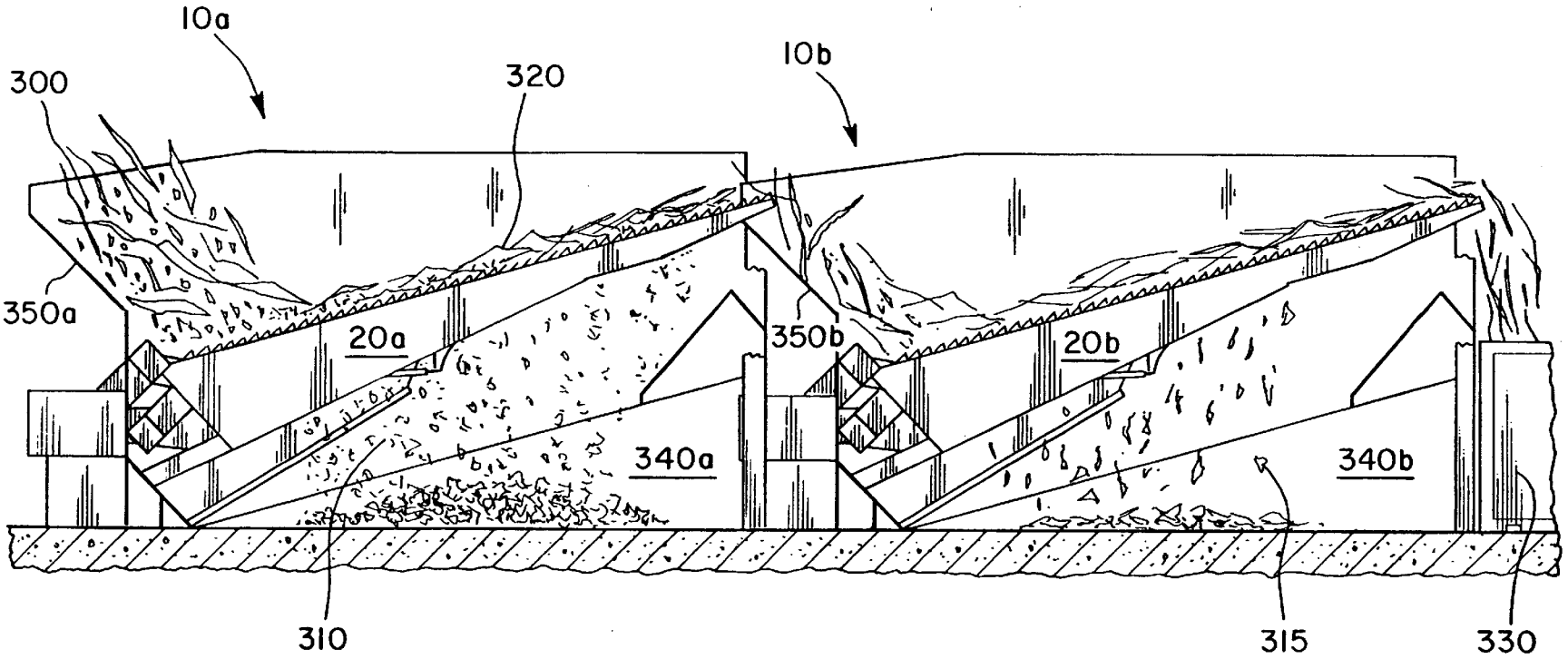
FIG. 3 is a side view of the separating apparatus shown being used in successive stages.

Preferably, at least the first conveyor 20*a* is inclined (e.g., at a 15% grade) and the second conveyor 20*b* is loaded beneath the far or distal end of the first conveyor 20*a*. In the preferred embodiment of the present invention, the angle of incline of the conveyor is adjustable. The incline helps the debris to fall back and into the collection area 340*a* rather than traveling through to the second conveyor 20*b* or hopper 330. In addition, a drop is created between the two conveyors 20*a* and 20*b* as shown in FIG. 3. As the corrugated paper 320 falls from the distal end of the first conveyor 20*a*, the drop causes a tumbling effect that loosens or otherwise separates any remaining debris 315 from the corrugated paper 320. The thrusting motion of the jogger beams 30, 35 also "kicks" the corrugated paper 320 as it falls from the distal end of the first conveyor 20*a* onto the second conveyor 20*b*, thus further enhancing the separation of the remaining debris 315 from the corrugated paper 320.

2. Details of the Conveyor

Figure 4A:
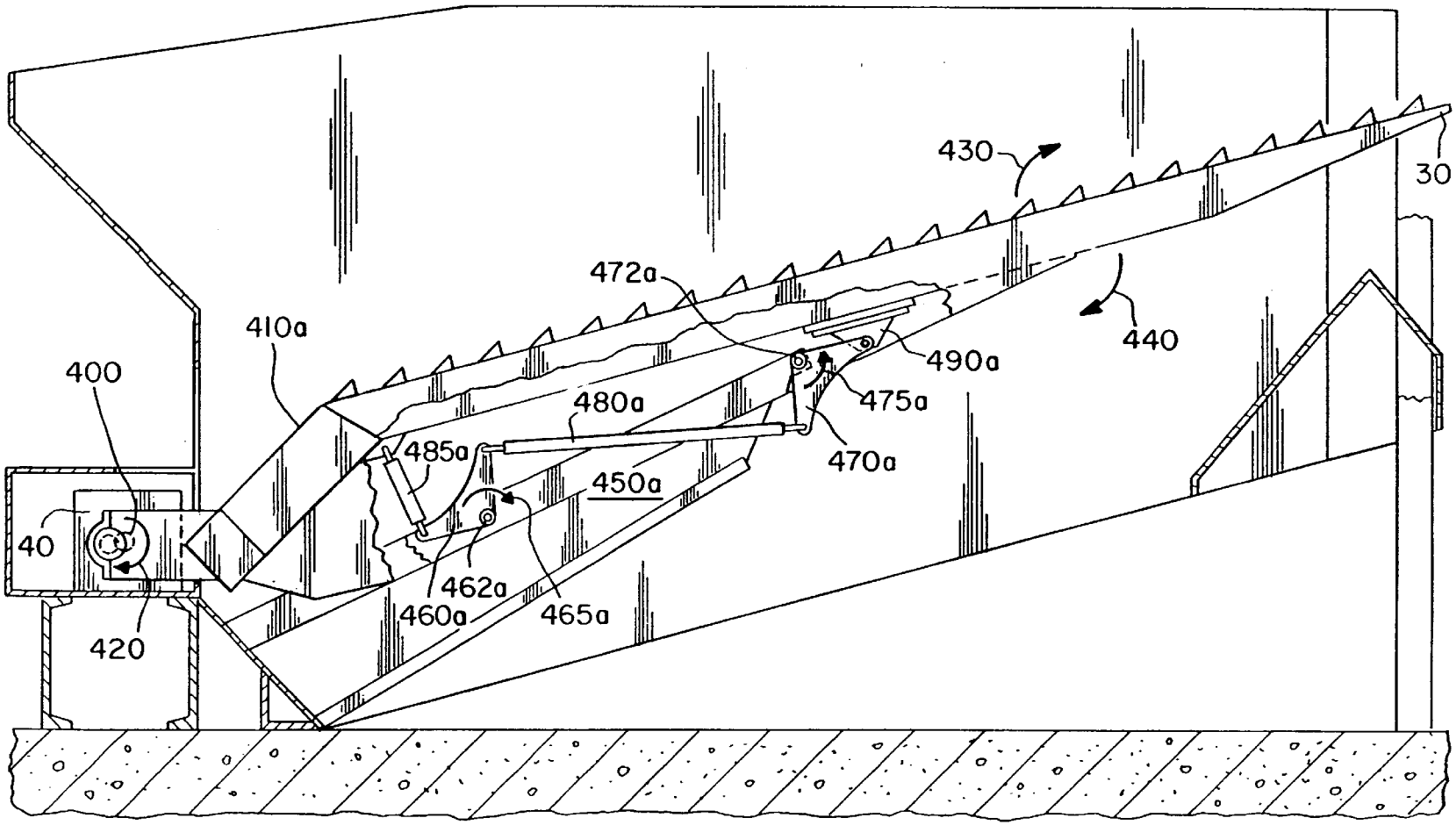
FIG. 4*a* is a side view of the first set of jogger beams.

A side view illustrating the mechanical linkage or drive mechanism of the first set of jogger beams 30*a–d* is shown in FIG. 4*a*. A first link arm 410*a* is connected off-center to the crankshaft 400. The crankshaft 400 is rotated (e.g., in the direction of arrow 420) by the motor 40 causing the jogger beam 30 to be thrust up and forward in the direction of arrow 430 and then down and back in the direction of arrow 440. This motion (i.e., in the direction of arrows 430 and 440) is preferably continuous and the distinction is made only to be illustrative. A fixed support arm 450*a* extends beneath the jogger beam 30 and has a first bell crank 460*a* and a second bell crank 470*a* pivotally attached thereon (i.e., at 462*a* and 472*a*, respectively) and linked to one another with a first tie rod 480*a*. A second tie rod 485*a* connects the jogger beam 30 (or alternately, the first link arm 410*a*) to the first bell crank 460*a*. Thus, in operation, as the jogger beam 30 is moved in the direction of arrow 430 as explained above, the tie rod 480*a* causes the first bell crank 460*a* to rotate in the direction of arrow 465*a*. Rotation of the first bell crank 460*a* causes the tie rod 480*a* to rotate the second bell crank 470*a* in the direction of arrow 475*a* which causes the slide shoe 490*a*, which slidingly engages the lower surface of the jogger beam 30, to lift the forward section of the jogger beam 30 and raise it in the direction of arrow 430. As the jogger beam 30 is then moved in the direction of arrow 440 as explained above, the tie rod 485*a* causes the first bell crank 460*a* to rotate in the opposite direction of arrow 465*a*. Rotation of the first bell crank 460*a* again causes tie rod 480*a* to rotate the second bell crank 470*a*, this time in the opposite direction of arrow 475*a* which causes the slide shoe 490*a* to lower and retreat or retract the jogger beam 30 in the direction of arrow 440.

Figure 4B:
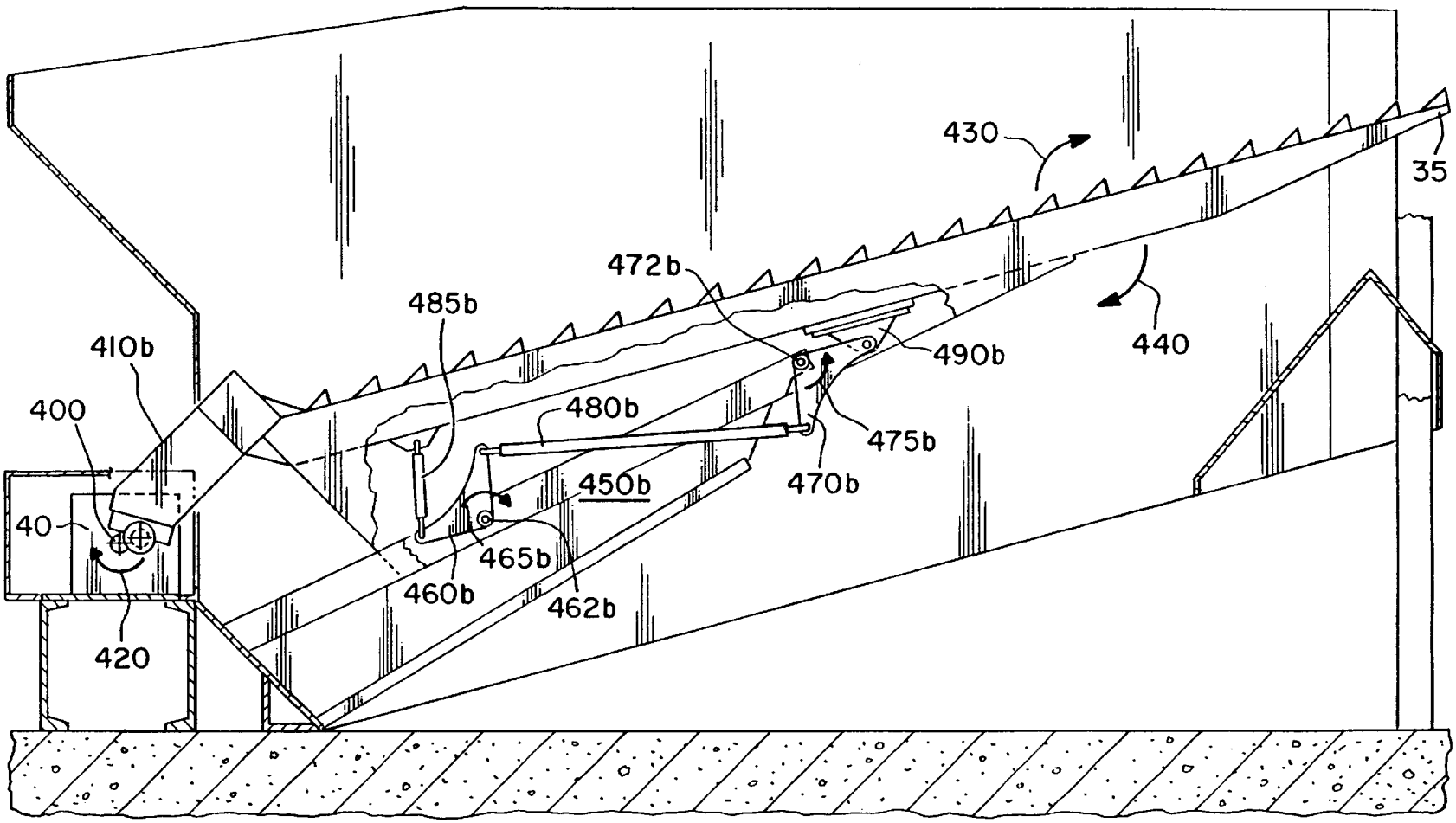
FIG. 4*b* is a side view of the second set of jogger beams.

A side view of the second set of jogger beams 35*a–d* is shown in FIG. 4*b*. A second link arm 410*b* is connected off-center to the crankshaft 400. The link arms 410*a* and 410*b* are oriented as shown in FIGS. 4*a* and 4*b* so that the link arms 410*a* and 410*b* can be operated simultaneously without interfering with one another. Other orientations are contemplated under the teachings of the present invention. In addition, the second link arm 410*b* is preferably 180 degrees out of phase to the connection of the first link arm 410*a* to the crankshaft 400. It is to be understood however, that the link arms 410*a*, 410*b* can have any suitable phase relationship with respect to one another (e.g., 90 degrees, 45 degrees, etc.). For example, where three sets of jogger beams (not shown) are used, each can be offset 120 degrees from each other. Alternatively, where three sets of jogger beams are used, two can coincide with one another and the third can be offset 180 degrees from the first two sets. Any suitable combination is possible under the teachings of the present invention and the above examples are only intended to be illustrative. The bell cranks 460*b*, 470*b* and tie rods 480*b* and 485*b* for the second set of jogger beams 35*a–d* are positioned and operate similarly to those shown in FIG. 3*a* for the first set of jogger beams 30*a–d* except that the two sets of jogger beams operate out of phase with respect to one another. That is, when the first set of jogger beams 30*a–d* is moving in the direction of arrow 430, the second set of jogger beams 35*a–d* is moving in the direction of arrow 440, and vice-versa.

The motion of the jogger beams 30, 35 described above conveys the commingled waste 300 from the first end where it is loaded onto the conveyor 20 to the opposite or distal end. As the material is moved across the conveyor 20, the waste or debris 310, 315 separates from the corrugated paper 320 and falls between the jogger beams 30, 35 into waste collection area 340*a*, 340*b*. The corrugated paper 320 is generally lighter and/or larger and therefore does not readily fall between the jogger beams 30, 35. Instead, the corrugated paper 320 is carried along the conveyor 20 to the opposite end where it is either collected in hopper 330 or transferred to a second conveyor (e.g., 20*b*).

3. Details of the Jogger Beams

Figure 5:
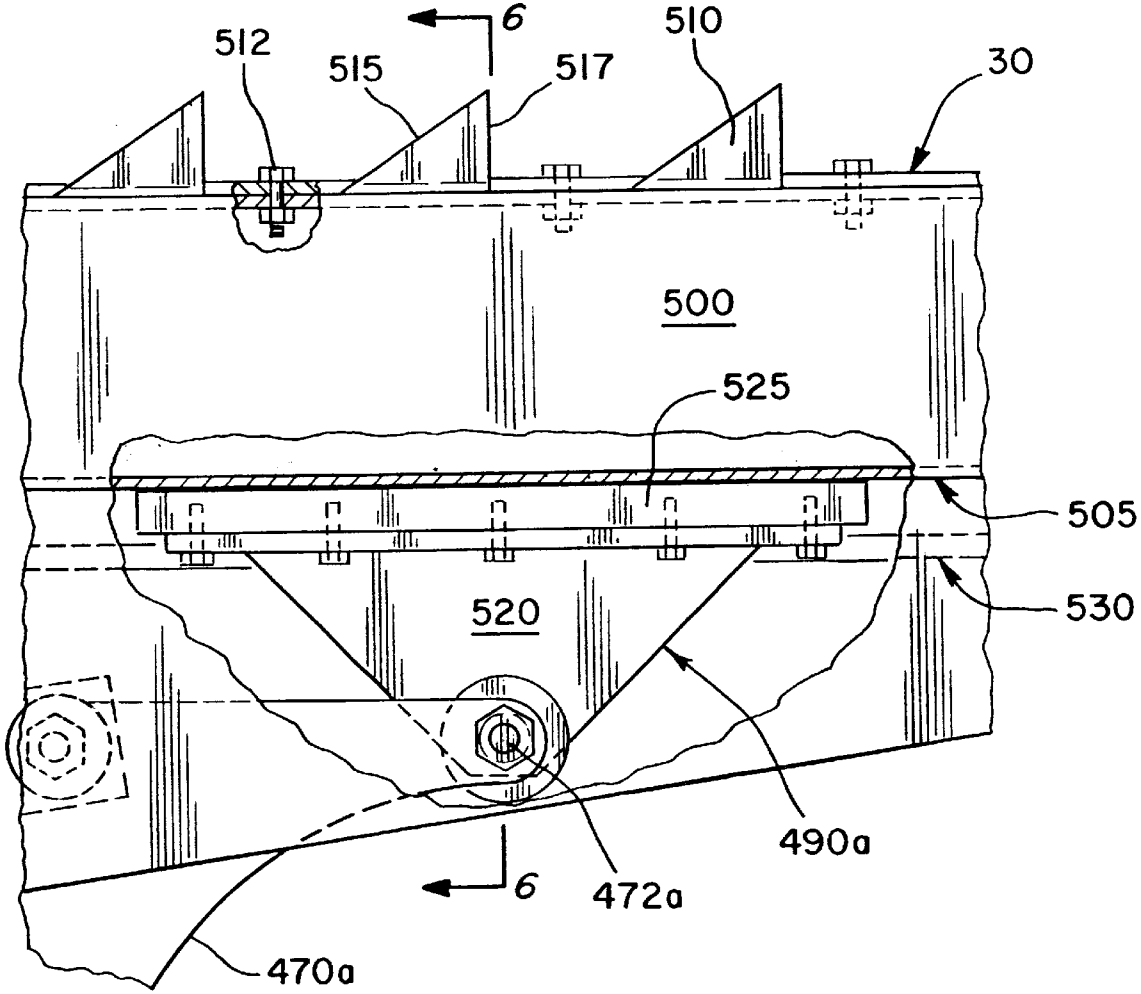
FIG. 5 is a detailed side view of a bell crank engaging the jogger beam.

One possible embodiment of the jogger beam and corresponding slide shoe are shown in FIG. 5. For purposes of illustration, only jogger beam 30 and slide shoe 490*a* are shown in FIG. 5, however, jogger beam 35 and slide shoe 490*b* are constructed and operate similarly. The jogger beam 30 is made of a shaft 500 with teeth 510 attached thereto. The teeth 510 are preferably cut from a single sheet of material (e.g., steel) formed with the teeth positioned upright when attached to the shaft 500 using fasteners 512 (e.g., bolts, welds, etc.). The teeth 510 preferably have a sloped side 515 and a vertical face 517. The sloped side 515 allows the material being conveyed (i.e., the corrugated paper) to readily slide forward, while the vertical face 517 retains the material at its current position between cycles (i.e., indicated by arrows 430 and 440 in FIGS. 4*a* and 4*b*) so that it can be conveyed forward without slipping back.

It is understood that the shaft 500 and teeth 510 can be integrally formed or can have separate components that are assembled using any suitable means to form jogger beam 30 (e.g., as shown in FIG. 5). Furthermore, the teeth 510 can be of any suitable shape that allows the material loaded thereon to be conveyed forward.

Figure 6:
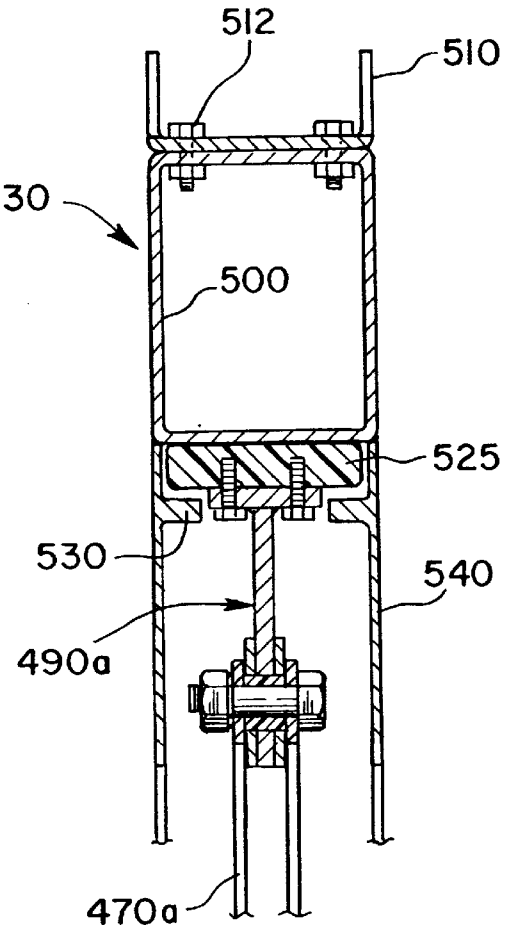
FIG. 6 is a cross-sectional view of a jogger beam taken along line 6—6 in FIG. 5.

The slide shoe 490*a* preferably includes a base 520 pivotally connected to the second bell crank 470*a* at 472*a*, and a pad 525. Pad 525 slidingly engages the lower surface 505 of the shaft 500. That is, the pad 525 is attached to the shaft 500 and readily slides across the lower surface 505. Preferably lips 530 (FIG. 6) form a channel beneath the shaft 500 for the pad 525 to slide within so that the shaft 500 does not disengage from the slide shoe 490*a* during operation. However, the channel can be formed as part of shaft 500 and in other embodiments, can be eliminated altogether. Also shown in FIG. 6, the jogger beam 30 preferably includes a skirt 540 attached to either side of shaft 500 and covering at least part of the mechanical linkage (i.e., slide shoe 490*a*, bell crank 470*a*, etc.). The skirt 540 protects the mechanical linkage from debris (e.g., 310) falling between the jogger beams 30, 35.

4. Method of Operation

In the preferred method of the present invention, the stream of commingled waste 300 is loaded onto the conveyor 20. The jogger beams 30, 35 of the conveyor 20*a* are alternately moved (i.e., out of phase with respect to one another) so that the stream of commingled waste 300 moves along the conveyor 20*a*. The debris 310 falls between and beneath the jogger beams 30, 35 and the corrugated paper 320 remains above and moves along the jogger beams 30, 35 to the opposite end of the conveyor 20*a* where the corrugated paper is then collected (e.g., in hopper 330) separately from the waste (e.g., in collection area 340*a*). Optionally, a second conveyor 20*b* (i.e., a second stage of jogger beams) positioned forward of the first conveyor 20*a* can be used to further separate the remaining debris 315 from the corrugated paper 320.

It is to be understood that the embodiment described with respect to FIG. 2 is a preferred embodiment. Alternatively, the second stage of jogger beams can be placed directly beneath the conveyor 20*a*. Other embodiments, including combinations of the examples given above are contemplated under the teachings of the present invention.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described herein and above is further intended to explain the best mode presently known of practicing the invention and to enable others skilled in the art to utilize the invention as such, or in other embodiments, and with the various modifications required by their particular application or uses of the invention. It is intended that the appended claims be construed to include alternate embodiments to the extent permitted by the prior art.

I claim:

1. A method to separate corrugated paper from a stream of commingled waste containing corrugated paper and other waste, said method comprising the steps of:

loading the stream of commingled waste onto a conveyor, said conveyor having at least two substantially parallel jogger beams separated by a spacing;

alternating the motion of said two jogger beams to move said stream of commingled waste along said conveyor;

separating the corrugated paper from the other waste as the stream of commingled waste is moved along said conveyor, the other waste falling between and beneath said two jogger beams and said corrugated paper remaining above and moving along said two jogger beams;

collecting said corrugated paper separately from the other waste at a distal end of said conveyor.

2. The method of claim 1 wherein the step of alternating the motion of said two jogger beams further includes the step of moving at least one jogger beam forward and upward while moving at least one jogger beam rearward and downward.

3. The method of claim 1 wherein the step of alternating the motion of said two jogger beams uses a drive motor to move said jogger beams and said jogger beams are cantilevered beyond said drive motor.

4. The method of claim 1 wherein said jogger beams are inclined.

5. A recycling apparatus for separating corrugated paper from a stream of commingled waste containing corrugated paper and other waste, said recycling apparatus comprising:

a conveyor having at least two substantially parallel jogger beams spaced apart from one another, said stream of commingled waste loaded onto said two jogger beams;

a drive mechanism driving each of said jogger beams, said drive mechanism including:

(a) a motor driving said two jogger beams out of phase with respect to one another to move said stream of commingled waste along said conveyor;

(b) a crankshaft driven by said motor;

(c) a link arm extending from a first end of said jogger beam and pivotably connected to said crankshaft;

(d) a first bell crank pivotably mounted beneath said first end of said jogger beam;

(e) a first tie rod connecting said first end of said jogger beam to said first bell crank;

(f) a second bell crank pivotably mounted beneath said jogger beam;

(g) a second tie rod connecting said first bell crank to said second bell crank; and (h) a slide shoe pivotally connected to said second bell crank and slidingly engaging said jogger beam; and a collection area beneath the conveyor, the other waste falling between said two jogger beams and into said collection area, the corrugated paper remaining above and moving along said two jogger beams, thereby separating the corrugated paper from the other waste.

6. The recycling apparatus of claim 5 wherein said jogger beams are inclined.

7. The recycling apparatus of claim 5 further comprising a second stage of jogger beams following said conveyor.

8. The recycling apparatus of claim 7 wherein said second stage of jogger beams are positioned lower than the distal end of said conveyor creating a drop therebetween to further separate said stream of commingled waste.

9. The apparatus of claim 8 wherein at least one jogger beam is thrust forward and upward while at least one jogger beam is moved rearward and downward thereby causing the corrugated paper dropping from said conveyor onto said second stage of jogger beams to tumble to further separate the waste from the corrugated paper.

10. The apparatus of claim 5 further comprising a skirt at least partially covering said first and second bell cranks and said slide shoe.

11. The apparatus of claim 5 wherein said jogger beams further include teeth.

12. The apparatus of claim 11 wherein said teeth are formed on a single sheet of metal fashioned into a substantially U-shape and secured to said jogger beams.

13. An apparatus for separating recyclable corrugated paper from a stream of commingled waste containing corrugated paper and other waste, said apparatus comprising:

a conveyor having at least two sets of jogger beams, said stream of commingled waste loaded thereon, and a drive mechanism including:

(a) a motor, said jogger beams being cantilevered beyond said motor, (b) a crankshaft driven by said motor, (c) a link arm extending from a first end of said jogger beam and pivotably connected to said crankshaft, so that said sets of jogger beams are driven out of phase with respect to one another by said crankshaft;

(d) a first bell crank pivotably mounted beneath said first end of said jogger beams;

(e) a first tie rod connecting said first end of each set of jogger beams to said first bell crank;

(f) a second bell crank pivotably mounted beneath said jogger beams;

(g) a second tie rod connecting said first bell crank to said second bell crank for each set of jogger beams; and (h) a slide shoe pivotally connected to said second bell crank and slidingly engaging at least one jogger beam of each set of jogger beams; and a collection area beneath said conveyor, with the other waste falling between said jogger beams and into said collection area, said corrugated paper remaining above and moving along and toward a distal end of said jogger beams, thereby separating the corrugated paper from the other waste.

14. The apparatus of claim 13 further including a skirt covering said drive mechanism.

15. The apparatus of claim 13 wherein said jogger beams further include teeth.

16. The apparatus of claim 15 wherein said teeth are formed on a single sheet of metal fashioned into a substantially U-shape secured to said jogger beams.

17. The apparatus of claim 13 wherein said jogger beams are inclined.

18. The apparatus of claim 13 further comprising a second stage of jogger beams positioned forward of said conveyor and lower than the distal end of said conveyor creating a drop therebetween to further separate said stream of commingled waste.

* * * * *